US007544093B2

(12) United States Patent
Soubh et al.

(10) Patent No.: US 7,544,093 B2
(45) Date of Patent: Jun. 9, 2009

(54) COMPLIANT COAXIAL CONNECTOR

(75) Inventors: Emad Soubh, Camas, WA (US); Robert Marine Santos, Vancouver, WA (US); Jon Hoffman, Vancouver, WA (US); Travis Ellis, Portland, OR (US)

(73) Assignee: Samtec, Inc., New Albany, IN (US)

( * ) Notice: Subject to any disclaimer, the term of this patent is extended or adjusted under 35 U.S.C. 154(b) by 28 days.

(21) Appl. No.: 11/778,832

(22) Filed: Jul. 17, 2007

(65) Prior Publication Data

US 2009/0023333 A1 Jan. 22, 2009

(51) Int. Cl.
*H01R 9/05* (2006.01)

(52) U.S. Cl. ..... 439/581

(58) Field of Classification Search ..... 439/581, 439/70–71, 441, 608
See application file for complete search history.

(56) References Cited

U.S. PATENT DOCUMENTS

2002/0050388 A1* 5/2002 Simpson ..... 174/88 C
2004/0183739 A1* 9/2004 Bisiules et al. ..... 343/795

* cited by examiner

*Primary Examiner*—Jean F Duverne
(74) *Attorney, Agent, or Firm*—Keating & Bennett, LLP

(57) ABSTRACT

A connector includes a connector body, a plurality of compression coaxial contacts disposed in the connector body, and a plurality of coaxial cables connected to corresponding ones of the plurality of compression coaxial contacts. The connector body includes a conductive elastomeric ground plane.

20 Claims, 10 Drawing Sheets

COMPLIANT COAXIAL CONNECTOR

BACKGROUND OF THE INVENTION

1. Field of the Invention

The present invention relates to radio frequency (RF) coaxial connectors. More specifically, the present invention relates to coaxial connectors having a conductive elastomeric ground plane.

2. Description of the Related Art

Many connectors are known in the RF connector field. One known type of RF connector includes two end connectors that are connected by a coaxial wire. End connectors typically include threaded caps that are screwed onto a corresponding connector to provide a mechanical and electrical connection. Examples of this type of RF connector are SMA, GPO, and MMCX connectors. With this type of RF connector, a connector is required for each signal line. That is, if there are four signal lines, then four connectors are required.

These types of RF connectors have several problems. They are expensive because an RF connector is required for each signal line. The density of this type of connector is relatively low and is limited by the size of the end connector and by any tool needed to connect this type of connector to a printed circuit board. A connector must be provided on the target printed circuit board by soldering or screwing, which makes the RF connector very hard to replace in the field. Often the small size of RF connectors requires very high un-mating forces which often causes damage to the solder joint or the target printed circuit board. Mating and un-mating of the RF connectors requires a large amount of time. Because only one signal line at a time can be mated, the chance of incorrectly mating the signals of the RF connector increases.

Another known type of RF connector includes a plurality of coaxial wires, in which one end of the plurality of coaxial wires is connected to an end connector and in which the other ends of the plurality of coaxial wires are arranged in an array that uses connector-less solutions, e.g., gold dot, fuzz button, silver particles suspended in an elastomer, etc. With this type of RF connector, a single connector can be used when multiple signal lines are required.

This type of RF connector has several problems. The electrical performance of these connectors is relatively poor. The lifetime of some of these connectors is relatively short because of the limited mating cycles of the connector-less solutions. Some of these connectors also require a large normal force to mate the connector.

SUMMARY OF THE INVENTION

To overcome the problems described above, preferred embodiments of the present invention provide a connector including a connector body, a plurality of compression coaxial contacts disposed in the connector body, and a plurality of coaxial cables connected to corresponding ones of the plurality of compression coaxial contacts. The connector body includes a conductive elastomeric ground plane, and at least a portion of each of the plurality of compression coaxial contacts is disposed in the conductive elastomeric ground plane.

The connector body can include a plurality spacer layers. The plurality of spacer layers are connected to each other by a plurality of screws or other fastening members. At least one of the plurality of spacer layers preferably includes a hole in which all of the plurality of compression coaxial contacts are disposed. At least one of the plurality of spacer layers preferably includes a plurality of holes, and each of the plurality of compression coaxial contacts is disposed in a corresponding one of the plurality of holes. Each of the plurality of compression coaxial contacts preferably includes at least one retention arm. The connector preferably further includes at least one spacer layer having a plurality of holes corresponding to the plurality of compression coaxial contacts, where each of the plurality of holes includes at least one slot and at least one ledge.

Each of the plurality of compression coaxial contacts preferably includes a cable retaining nut, a spring, and a ground housing. Each of the plurality of coaxial cables preferably includes a center conductor, an insulator, and an external conductor. The ground housing is movable with respect to the cable retaining nut. When the connector is connected to a circuit board, the spring is preferably arranged to push the ground housing toward the circuit board.

Each of the plurality of compression coaxial contacts preferably includes a signal probe, a ground housing, and a contact insulator. The signal probe, the ground housing, and the contact insulator are preferably arranged to have a coaxial structure. Preferably, the center conductor is connected to the signal probe, the insulator is connected to the contact insulator, and the external conductor is connected to the ground housing.

The connector body preferably includes a pluralities of holes into which a plurality of screws can be inserted to attach the connector body to a circuit board. The plurality of holes are preferably arranged such that an equal or substantially equal compression force is provided throughout the connector when the connector body is attached to the circuit board.

Another preferred embodiment of the present invention provides a connector assembly including test equipment and a connector according to one of the preferred embodiments of the present invention. The connector assembly preferably further includes a circuit board to which the connector is attached. The conductive elastomeric ground plane is preferably connected to ground in the circuit board.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
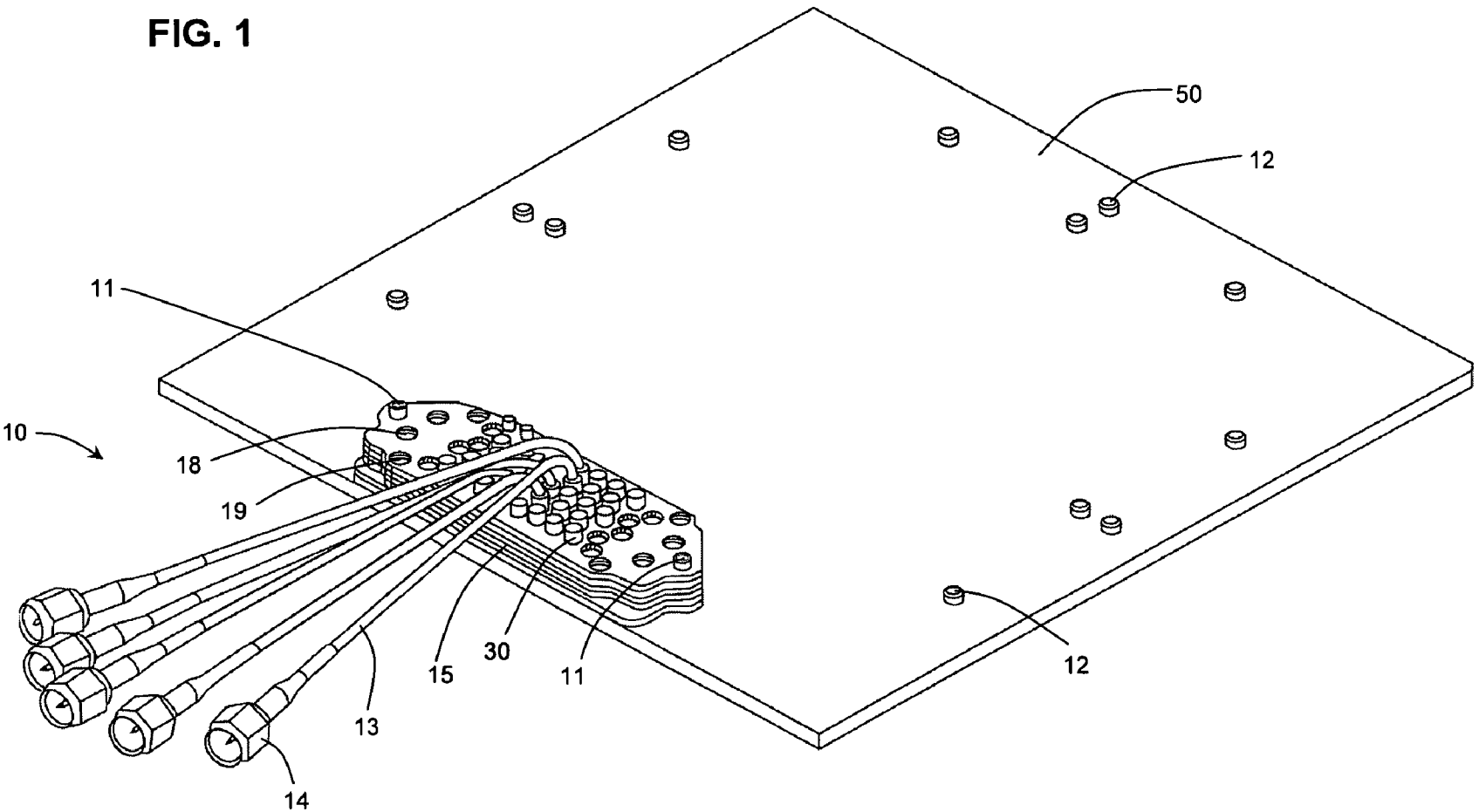
FIG. 1 is perspective view of a compliant coaxial connector according to a preferred embodiment of the present invention.
Figure 2:
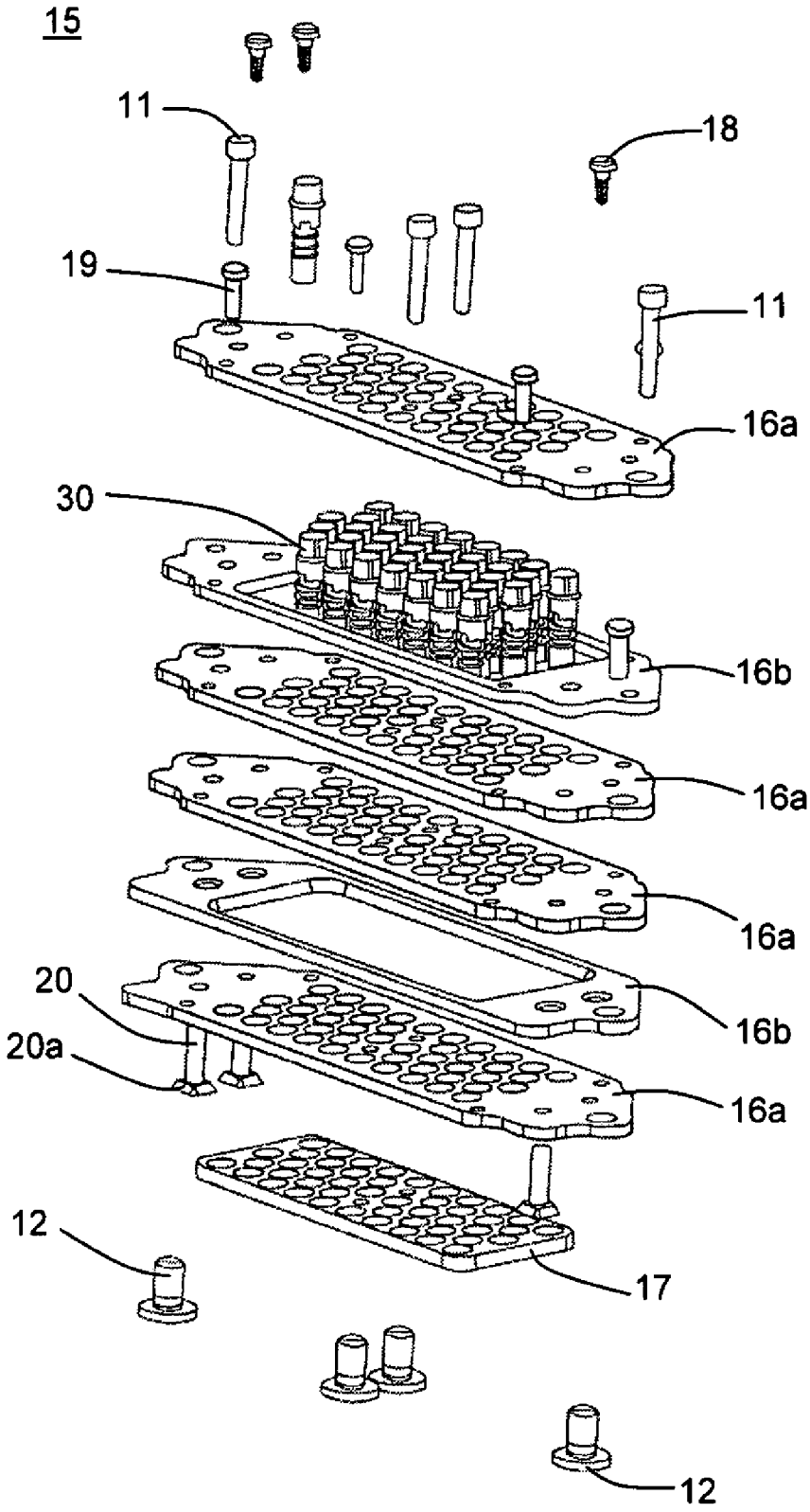
FIG. 2 is an exploded view of a compliant coaxial connector according to a preferred embodiment of the present invention.
Figure 3A:
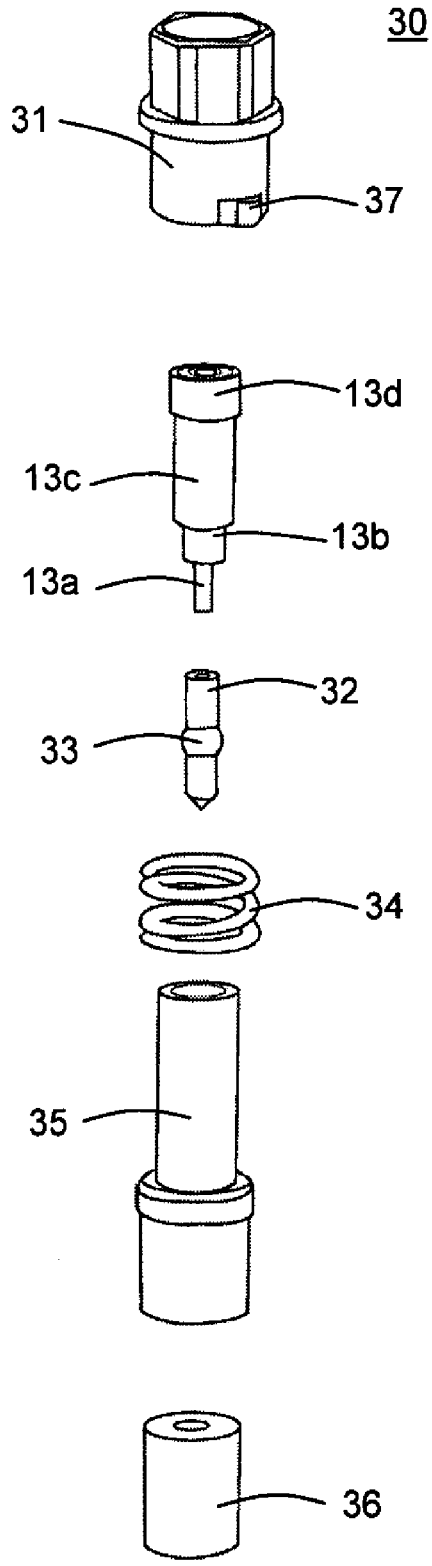
FIG. 3A is an exploded view of a compression coaxial contact according to a preferred embodiment of the present invention.
Figure 3B:
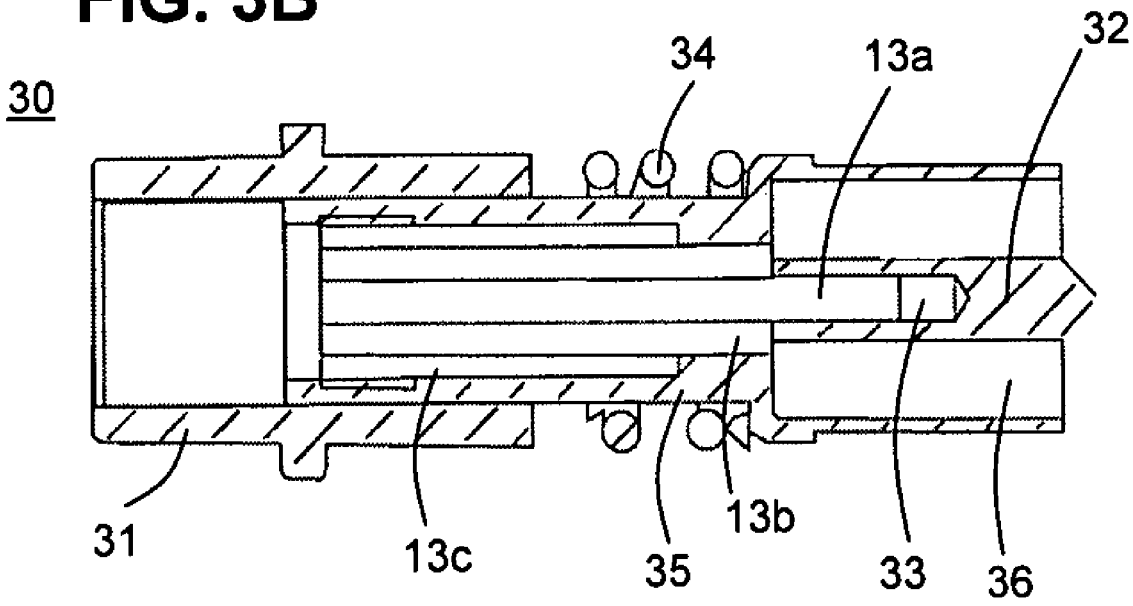
FIG. 3B is a sectional view of a compression coaxial contact according to a preferred embodiment of the present invention.
Figure 3C:
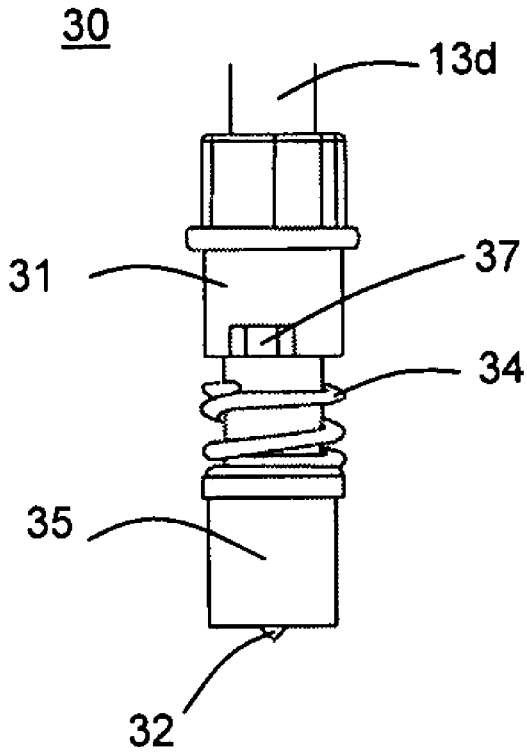
FIG. 3C is side view of a compression coaxial contact according to a preferred embodiment of the present invention.

FIGS. 1 and 2 show a compliant coaxial connector 10 according to a preferred embodiment of the present invention. FIGS. 3A-3C show a compression coaxial contact 30 according to a preferred embodiment of the present invention.

Compliant coaxial connector 10 includes coaxial cables 13, end connectors 14, compression coaxial contacts 30, and a connector body 15. One end of each of the coaxial cables 13 is connected to an end connector 14, and the other end of each of the coaxial cables 13 is connected to a corresponding compression coaxial contact 30 that is disposed in the connector body 15. Typically, 2.92 or 1.8 SMA or MSMP connectors are used as the end connectors 14. However, any other suitable end connector can also be used. The end connectors 14 are preferably connected to test equipment (not shown).

For the sake of clarity, FIG. 1 only shows a partially assembled compliant coaxial connector 10. The connector body 15 of the compliant coaxial connector 10 is attached to a circuit board 50. The connector body 15 is preferably attached to the circuit board 50 by screws 11 and bosses 12. Typically, bosses 12 are internally threaded standoffs. However, any other suitable attachment mechanism can also be used. For example, instead of using screws 11 and bosses 12, the connector body 15 can be connected to the circuit board 50 by rivets or any other suitable connecting method. The connector body 15 of the compliant coaxial connector 10 preferably includes two holes at opposing ends of the connector body 15 and two holes in the middle or substantially in the middle of the connector body 15. This arrangement of holes in the connector body 15 allows for an equal or substantially equal compression force throughout the compliant coaxial connector 10 when the connector body 15 is attached to the circuit board 50 by the screws 11 and bosses 12. It is possible to use different arrangements of the holes in the connector body. The circuit board 50 includes holes that are arranged in a similar manner as the holes in the connector body 15.

The bosses 12 are inserted into holes in the circuit board 50, and the screws 11 are inserted into holes in the connector body 15 and screwed into the bosses 12. The bosses 12 are pressed into the circuit board 50, which prevents the bosses 12 from turning when the screws 11 are inserted and screwed into the bosses 12. Preferably, the bosses 12 have been tapped so that the screws 11 are easily screwed into bosses 12.

FIG. 2 shows an exploded view of the compliant coaxial connector 10. The connector body 15 includes spacer layers 16*a* and 16*b* and conductive elastomeric ground plane 17. Spacer layers 16*a* preferably include holes for positioning the compression coaxial contacts 30 with respect to the connector body 15. Spacer layers 16*b* preferably include a single hole for encompassing all of the compression coaxial contacts 30. Spacer layers 16*b* are preferably used because they make the manufacturing of the connector body 15 easier because spacer layers 16*b* do not require the careful alignment of the compression coaxial contacts 30 with respect to the holes of the spacer layers 16*a*. Further, each of the spacer layers 16*a* and 16*b* also includes the holes, discussed above, into which the screws 11 are inserted. It is also possible to use spacer layers that have different arrangements. For example, instead of using a spacer layer 16*b* with a single hole for encompassing all of the compression coaxial contacts 30, a spacer layer having two or more holes for encompassing all of the compression coaxial contacts 30 could be used.

As shown in FIG. 2, the connector body 15 preferably includes, in order from top to bottom, a spacer layer 16*a*, a spacer layer 16*b*, two spacer layers 16*a*, a spacer layer 16*b*, a spacer layer 16*a*, and the conductive elastomeric ground plane 17. However, different arrangements of the spacer layers 16*a* and 16*b* could be used. The spacer layers 16*a* and 16*b* may preferably be made of a rigid polymer material, e.g., LCP or PPA, or can be made of metal or metal alloy, e.g., steel.

The spacer layers 16*a* and 16*b* of the connector body 15 are preferably connected together by two types of screws, shoulder screws 18 and self-tapping screws 19. Tube nuts 20 are inserted into the spacer layers 16*a* and 16*b*, and the shoulder screws 18 are screwed into the tube nuts 20. Tube nuts 20 are preferably prevented from rotating by square flanges 20*a*, which make it easier to screw the shoulder screws 18 into the tube nuts 20. Self-tapping screws 19 are screwed into holes in the spacer layers 16*a* and 16*b*. Two different screws are used to hold the parts together better and to make manufacturing easier. It is also possible to use a different arrangement to attach the spacer layers 16*a* and 16*b* together. For example, it is possible to use only a single type of screw or to use more than two types of screws to attach the spacer layers 16*a* and 16*b* together. It is also possible to use glue, epoxy, or any other suitable material to attach the spacer layers 16*a* and 16*b* together.

The conductive elastomeric ground plane 17 is preferably attached to the connector body 15 by a friction fit. However, any other suitable method of attaching the conductive elastomeric ground plane 17 to the connector body 15 can also be used. The conductive elastomeric ground plane 17 is preferably made of fluorosilicone with a filler of silver or aluminum particles with a Shore A hardness of about 70. However, other suitable materials, filler metals, and hardnesses can also be used.

The screws 11 and the bosses 12 are not relied upon to form the connector body 15. Screws 11 and bosses 12, as described above, are used to attach the connector body 15 to the circuit board 50.

FIGS. 3A-3C are views of the compression coaxial contact 30 according to a preferred embodiment of the present invention. Each of the coaxial cables 13 is terminated to a corresponding compression coaxial contact 30. The coaxial cables 13 include a center conductor 13*a*, an insulator 13*b*, an external conductor 13*c*, and a jacket 13*d*. The center conductor 13*a* is surrounded by the insulator 13*b*. The insulator 13*b* is surrounded by the external conductor 13*c*. The external conductor 13*c* is surrounded by the jacket 13*d*.

The center conductor 13*a* preferably has a cylindrical or substantially cylindrical shape. However, the center conductor 13*a* could have a rectangular shape or other suitable shape. The center conductor 13*a* and the external conductor 13*c* are preferably made of copper. However, the center conductor 13*a* and the external conductor 13*c* can be made of brass, silver, gold, copper alloy, any highly conductive element that is machinable or manufacturable with a high dimensional tolerance, or any other suitable conductive material. The insulator 13*b* could be made of TEFLON™, FEP, air-enhanced FEP, TPFE, nylon, combinations thereof, or any other suitable insulating material. The jacket 13*d* can be made of the same materials as the insulator 13*b*, FEB, or any suitable insulating material.

Figure 3D:
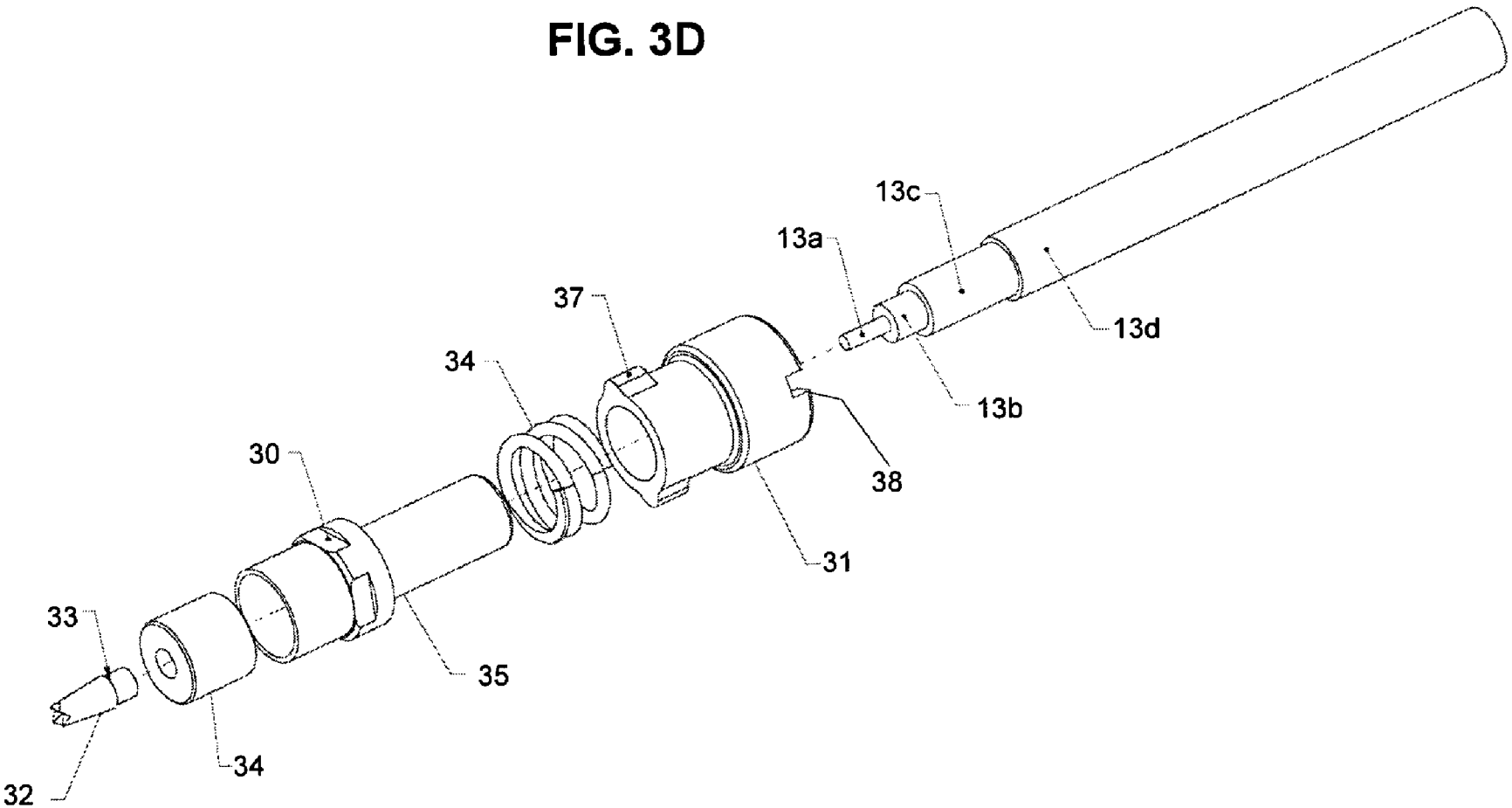
FIG. 3D is an exploded view of a compression coaxial contact according to a preferred embodiment of the present invention.

As shown in FIGS. 3A and 3D, a portion of the center conductor 13*a*, a portion of the insulator 13*b*, and a portion of the external conductor 13*c* are exposed before the coaxial cables 13 are connected to the corresponding compression coaxial contact 30. The center conductor 13*a* is connected to the signal probe 32. Preferably, the signal probe 32 includes a solder-on ferrule 33, and the center conductor 13*a* is soldered to the signal probe 32 to ensure an uninterrupted electrical connection. However, it is possible to use other suitable methods to connect the center conductor 13*a* to the signal probe 32, e.g., crimping, sonically welding, conductive soldering, convective soldering, inductive soldering, radiation soldering, otherwise melting solder to hold the two parts together, pushing the two parts together with enough force to weld the two parts together, or micro-flaming.

Signal probe 32 can have a regular tip as shown in FIG. 3A or a crown tip as shown FIG. 3D, or any other suitable type of tip. A benefit of using a crown tip is that multiple points of mechanical contact can be established using the crown tip, where the regular tip only provides a single mechanical contact. The use of multiple points of mechanical contact improves the electrical transmission characteristics of the signal probe 32. The multiple tips of the crown tip allow for the signal probe 32 to more easily break through the oxide layer formed on the electrical pad to which the signal probe is making the mechanical and electrical connection. If there is any dirt or debris on the electrical land, the multiple tips of the crown tip increase the chances that one of the tips misses the dirt or debris to make contact with the electrical contact.

Each of the compression coaxial contacts 30 includes a cable retaining nut 31, signal probe 32, a spring 34, a ground housing 35, and an insulator 36. The cable retaining nut 31 can include retention arms 37, which will be discussed below. The signal probe 32, the ground housing 35, and the insulator 36 are arranged such that a coaxial structure, similar to that of the coaxial cables 13, is maintained throughout the compression coaxial contact 30. That is, the signal probe 32 is surrounded by the insulator 36, and the insulator 36 is surrounded by the ground housing 35. Further, the signal probe 32 is connected to the center conductor 13a; the insulator 36 of the compression coaxial contact 30 is connected to the insulator 13*b* of the coaxial cable 13; and the ground housing 35 is connected to external conductor 13*c*. The tip of the signal probe 32 extends from the bottom of the compression coaxial contact 30.

The signal probe 32 and the ground housing 35 are preferably made of beryllium copper (BeCu) or brass with the tip gold plated so that the tip can penetrate any oxide layer any particles on any electrical pad (not shown) of the circuit board 50, but any other suitable conductor or plating could be used. The insulator 36 is preferably made of TEFLON™, but any other suitable insulator could be used.

The cable retaining nut 31, the spring 34, and the ground housing 35 are arranged such that the ground housing 35 is free to move with respect to the cable retaining nut 31 and such that, when the connector body 15 of the compliant coaxial connector 10 is attached to the circuit board 50, the spring 34 provides a force in the direction of the circuit board 50. The force provided by the spring 34 insures that the tip of the signal probe 32 makes a reliable contact with the electrical pad on the circuit board 50. The electrical pad can be made of gold, hard gold, soft gold, OSP, HASL, silver, copper, or any other suitable material so long as the oxide layer formed on the pad is not too thick. This arrangement of the cable retaining nut 31, the spring 34, and the ground housing 35 allows the tolerances in the surface flatness of the circuit board 50 to be relatively large.

The bottoms of the ground housings 35 from which the tips of the signal probes 32 extend are disposed in the conductive elastomeric ground plane 17. The conductive elastomeric ground plane 17 is connected to ground on the circuit board 50. The conductive elastomeric ground plane 17 is grounded by being connected to ground pads (not shown), ground plane (not shown), or any other electrically conductive part that is connected to ground. Because the conductive elastomeric ground plane 17 is compressible, the conductive elastomeric ground plane 17 maintains contact with the ground housing 35, which grounds the ground housing 35, when the connector body 15 is connected to the circuit board 50. Because the ground housing 35 is connected to the external conductor 13*c* of the coaxial cable 13, the coaxial cables 13 and the compression coaxial contacts 30 are connected to a common ground, i.e., the ground of the circuit board 50. By locating ground next to the signal transmitted through center conductor 13*a* and signal probe 32, the inductance of the signal can be kept relatively low; the cross-talk between adjacent signals can be kept relatively low; and the signal bandwidth can be kept from significantly degrading.

FIGS. 4A-4D show the compliant coaxial connector 10' according to another preferred embodiment of the present invention. In this preferred embodiment, parts similar to the parts used in the above discussed preferred embodiment have the same reference number. In this preferred embodiment, the compliant coaxial connector 10' includes a connector body 15'. The connector body 15' includes a single spacer layer 16*c*, a frame 40, and a conductive elastomeric ground plane 17.

The frame 40 and the spacer layer 16*c* are preferably connected to each other by screws 19. However, any other suitable method of connecting the frame 40 and the spacer layer 16*c* can also be used. Before the compliant coaxial connector 10' is attached to a motherboard, the conductive elastomeric ground plane 17 is attached to the connector body 15' by a friction fit. However, any other suitable method of attaching the conductive elastomeric ground plane 17 to the connector body 15' can also be used.

After the compliant coaxial connector 10' is attached to a motherboard, the conductive elastomeric ground plane 17, the frame 40, and the spacer layer 16*c* are preferably connected to each other by screws 11 and bosses 12. However, any other suitable method of connecting the conductive elastomeric ground plane 17, the frame 40, and the spacer layer 16*c* can also be used.

As with the previous preferred embodiment, compliant coaxial connector 10' also includes end connectors 14 and compression coaxial contacts 30 that are connected by coaxial cables 13. Compression coaxial contacts 30 are inserted into holes in the spacer layer 16*c*, the frame 40, and the conductive elastomeric ground plane 17. Further, the coaxial cables 13 include a center conductor 13*a*, an insulator 13*b*, an external conductor 13*c*, and a jacket 13*d*. The compression coaxial contacts 30 include a cable retaining nut 31, signal probe 32, a spring 34, a ground housing 35, an insulator 36, and retention arms 37.

Figure 4A:
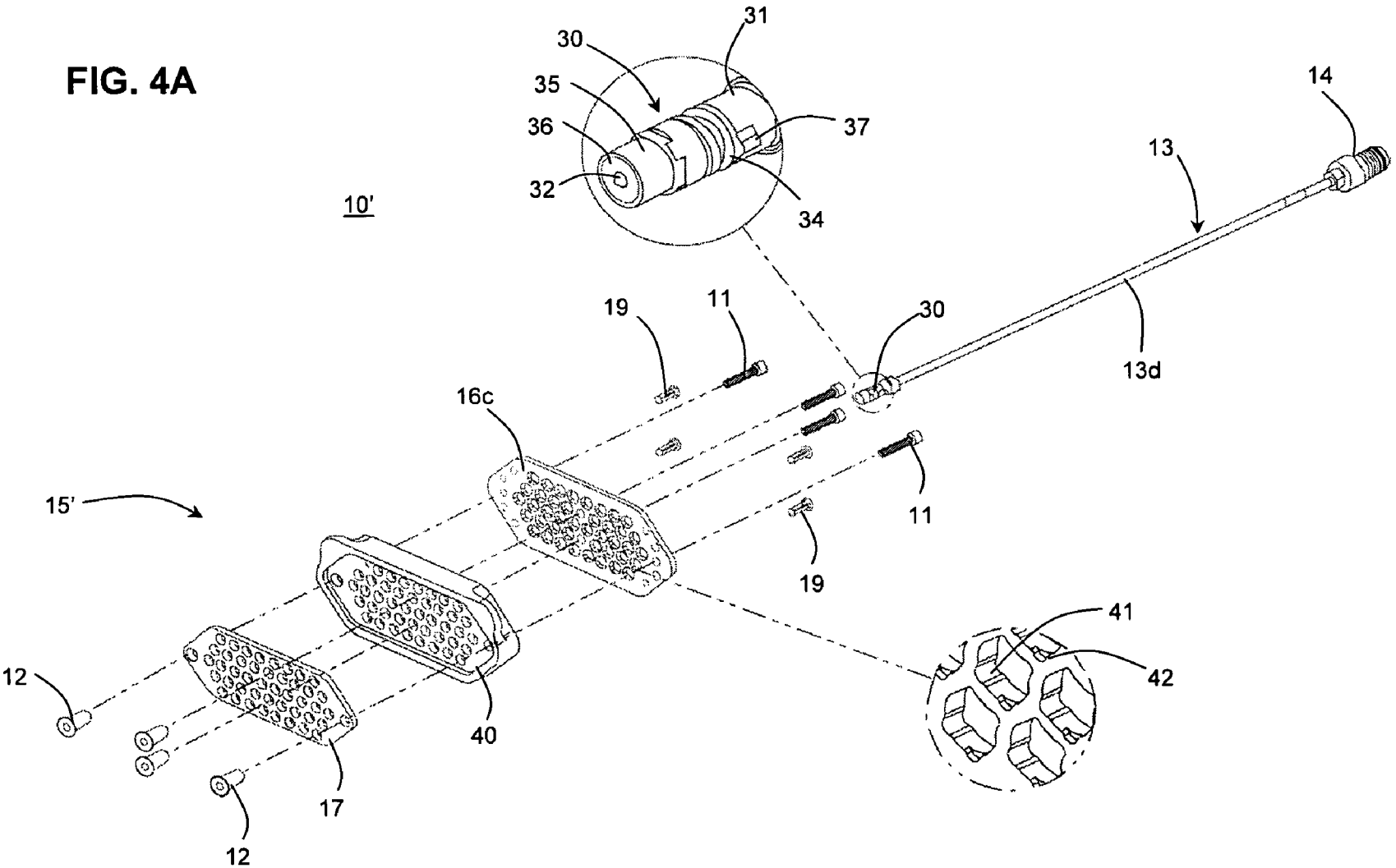
FIG. 4A is an exploded view of compliant coaxial connector according to another preferred embodiment of the present invention including several close-up views.
Figure 4B:
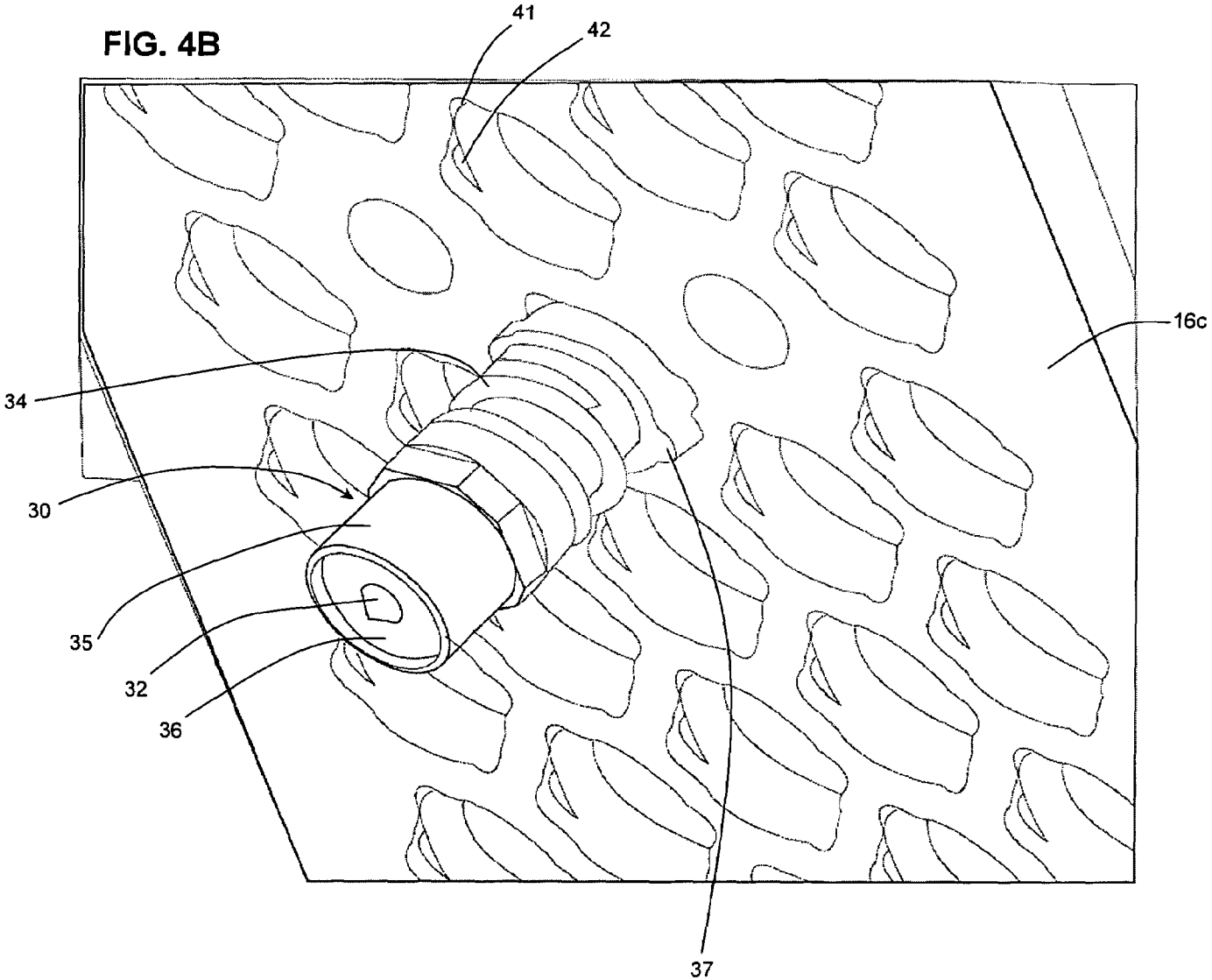
FIG. 4B is a partial, close-up view of the compliant coaxial connector according to another preferred embodiment of the present invention.
Figure 4C:
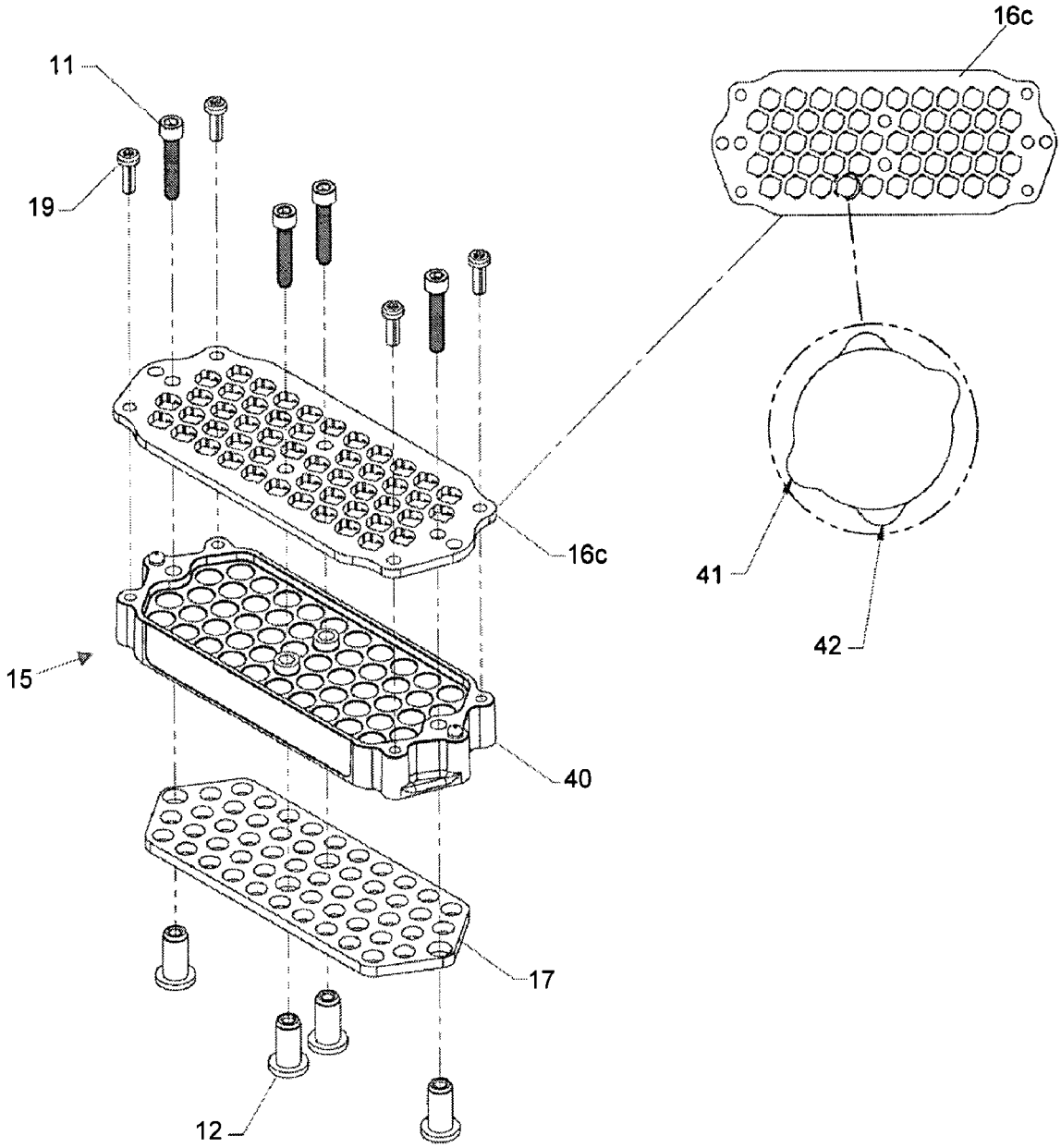
FIG. 4C is an exploded view of a connector body according to another preferred embodiment of the present invention including several close-up views.
Figure 4D:
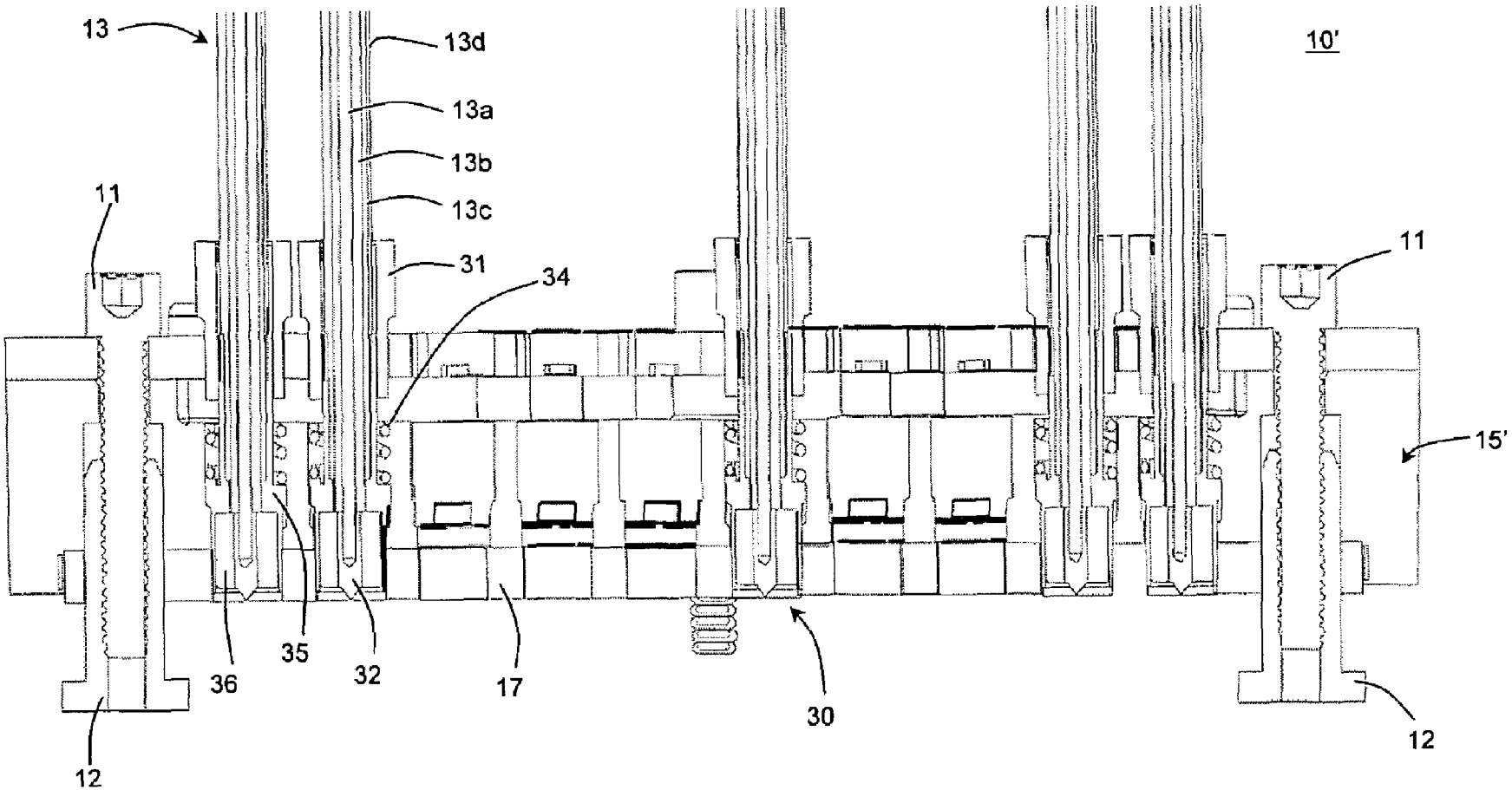
FIG. 4D is a sectional view of the compliant coaxial connector according to another preferred embodiment of the present invention.

The spacer layer 16*c* is similar to the spacer layer 16*a* discussed above, except that, as shown in the close-up in the lower right hand corner of FIG. 4A and as shown in FIG. 4B, spacer layer 16*c* includes retention features in the form of slots 41 and ledges 42. The slots 41 and the ledges 42 are preferably arranged and oriented at an angle of approximately 90° relative to each other. However, other suitable degrees of separation could also be used. Ledges 42 work in cooperation with the retention arms 37 of the cable retaining nut 31 and the spring 34 to provide a down force on the signal probe 32 through the ground housing 35.

The compression coaxial contact 30 is inserted into the connector body 15' such that the retention arms 37 are aligned with the slots 41. After the compression coaxial contact 30 is inserted into the connector body 15', the compression coaxial contact 30 is turned such that the retention arms 37 are aligned with the ledges 42. With this arrangement, it is difficult to remove the compression coaxial contact 30 from the connector body 15' without turning the compression coaxial contact 30 such that the retention arms 37 are aligned with slots 41. Preferably, there are two slots 41 and ledges 42 in the hole in the spacer layer 16*c* and two corresponding retention arms 37 on the compression coaxial contact 30. However, there could be one, or three or more, of each of the slots 41, ledges 42, and retentions arms 37.

As explained above, when the compression coaxial contact 30 is inserted into the connector body 15', a downward force is provided to the signal probe 32 by the spring 34. This downward force ensures a good mechanical connection between the signal probe 32 and the electrical pad on the circuit board 50, which ensures a good electrical connection.

Figure 5A:
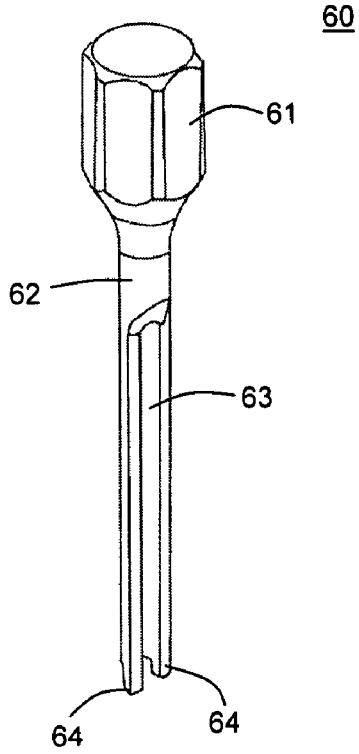
FIGS. 5A and 5B are a perspective view and a side view, respectively, of a tool according to yet another preferred embodiment of the present invention.
Figure 5B:
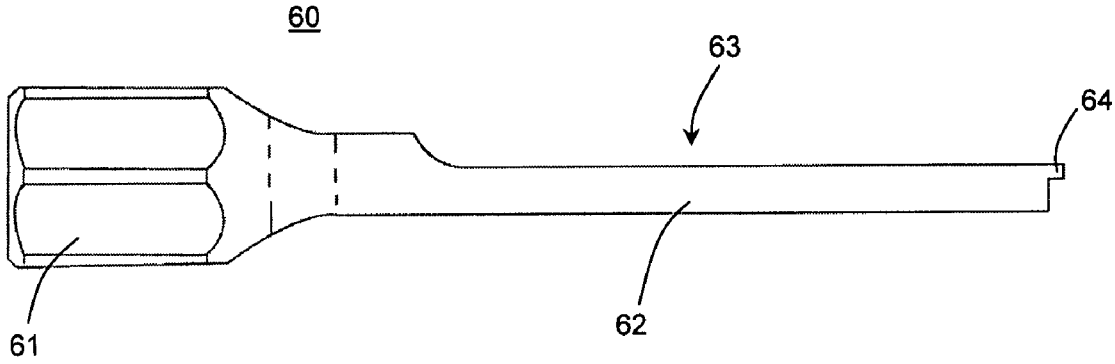

FIGS. 5A and 5B show a tool 60 according to yet another preferred embodiment of the present invention. The tool 60 can be used with either the compliant coaxial connector 10 shown in FIGS. 1 and 2 or the compliant coaxial connector 10' shown in FIGS. 4A-4D. For the sake of clarity, the use of the tool 60 is only described with respect to compliant coaxial connector 10'. Tool 60 is used to insert and remove the compression coaxial contact 30 from the connector body 15'. Tool 60 includes a handle 61, a stem 62 with groove 63, and a pair of projections 64.

To insert or remove a compression coaxial contact 30, the pair of projections 64 are inserted into corresponding slots 38 (only one slot is shown in FIG. 3D) of the cable retaining nut 31 of the compression coaxial contact 30 such that the coaxial cable 13 is partially surrounded by the groove 63 of the tool 60. To insert a compression coaxial contact 30, the tool 60 is turned using the handle 61 until the retention arms 37 of the cable retaining nut 31 are aligned with the slots 41 of the spacer layer 16*c*. Then, the tool 60 is pushed and twisted so that the cable retaining nut 31 is fully inserted into the spacer layer 16*c* and twisted, which results in the retention arms 37 of the cable retaining nut 31 engage with the ledges 42 of the spacer layer 16*c*. To remove a compression coaxial contact 30, the tool 60 is twisted so that the retention arms 37 of the cable retaining nut 31 are disengaged from the ledges 42 of the spacer layer 16*c* and until the retention arms 37 of the cable retaining nut 31 are aligned with the slots 41 of the spacer layer 16*c*, which allows the compression coaxial contact 30 to be removed from the connector body 15'.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A connector comprising:

a connector body;

a plurality of compression coaxial contacts disposed in the connector body and arranged such that, when the connector is connected to a circuit board, each of the plurality of compression coaxial contacts is connected to a corresponding electrical pad on the circuit board; and a plurality of coaxial cables connected to corresponding ones of the plurality of compression coaxial contacts; wherein the connector body includes a conductive elastomeric interface;

the conductive elastomeric interface is arranged such that, when the connector is connected to a circuit board, the conductive elastomeric interface is connected to a ground on the circuit board by directly contacting a surface of the circuit board; and at least a portion of each of the plurality of compression coaxial contacts is disposed in the conductive elastomeric interface.

2. A connector according to claim 1, wherein the connector body includes a plurality of spacer layers.

3. A connector according to claim 2, wherein at least one of the plurality of spacer layers includes a hole in which all of the plurality of compression coaxial contacts are disposed.

4. A connector according to claim 2, wherein at least one of the plurality of spacer layers includes a plurality of holes; and each of the plurality of compression coaxial contacts is disposed in a corresponding one of the plurality of holes.

5. A connector according to claim 1, wherein each of the plurality of compression coaxial contacts includes a cable retaining nut, a spring, and a ground housing.

6. A connector according to claim 5, wherein the ground housing is movable with respect to the cable retaining nut.

7. A connector assembly comprising:

test equipment; and the connector according to claim 1.

8. A connector assembly according to claim 7, further comprising a circuit board to which the connector is attached.

9. A connector assembly according to claim 7, wherein the conductive elastomeric interface is connected to ground in the circuit board.

10. A connector according to claim 1, wherein the connector body includes a pluralities of holes into which a plurality of screws can be inserted to attach the connector body to a circuit board.

11. A connector according to claim 10, wherein the plurality of holes are arranged such that an equal or substantially equal compression force is provided throughout the connector when the connector body is attached to the circuit board.

12. A connector according to claim 2, wherein the plurality of spacer layers are connected to each other by a plurality of screws.

13. A connector according to claim 1, wherein each of the plurality of coaxial cables includes a center conductor, an insulator, and an external conductor.

14. A connector according to claim 13, wherein the center conductor is connected to the signal probe;

the insulator is connected to the contact insulator; and the external conductor is connected to the ground housing.

15. A connector according to claim 1, further comprising at least one spacer layer having a plurality of holes corresponding to the plurality of compression coaxial contacts; and each of the plurality of holes includes at least one slot and at least one ledge.

16. A connector according to claim 15, wherein each of the plurality of compression coaxial contacts includes at least one retention arm.

17. A connector according to claim 1, wherein each of the plurality of compression coaxial contacts includes at least one retention arm.

18. A connector comprising:

a connector body;

a plurality of compression coaxial contacts disposed in the connector body; and a plurality of coaxial cables connected to corresponding ones of the plurality of compression coaxial contacts; wherein the connector body includes a conductive elastomeric ground plane; and at least a portion of each of the plurality of compression coaxial contacts is disposed in the conductive elastomeric ground plane;

each of the plurality of compression coaxial contacts includes a cable retaining nut, a spring, and a ground housing; and when the connector is connected to a circuit board, the spring is arranged to push the ground housing toward the circuit board.

19. A connector according to claim 1, wherein each of the plurality of compression coaxial contacts includes a signal probe, a ground housing, and a contact insulator.

20. A connector according to claim 19, wherein the signal probe, the ground housing, and the contact insulator are arranged to have a coaxial structure.

* * * * *